US005416961A

United States Patent [19]

Vinay

[11] Patent Number: 5,416,961

[45] Date of Patent: May 23, 1995

[54] KNITTED WIRE CARRIER HAVING BONDED WARP THREADS AND METHOD FOR FORMING SAME

[75] Inventor: Paul M. Vinay, Rock Hill, S.C.

[73] Assignee: Schlegel Corporation, Rochester, N.Y.

[21] Appl. No.: 186,773

[22] Filed: Jan. 26, 1994

[51] Int. Cl.[6] ..... D04B 21/14; D06M 23/00; E06B 7/16

[52] U.S. Cl. ..... 28/165; 66/190; 66/202; 49/475.1; 49/490.1; 428/253; 428/296

[58] Field of Search ..... 66/190, 202; 277/235, 277/DIG. 6; 296/83; 49/475.1, 490.1; 156/242, 245; 428/253, 296; 28/165

[56] References Cited

U.S. PATENT DOCUMENTS

| | | | |
|---|---|---|---|
| 2,460,674 | 2/1949 | Bihaly | 66/202 X |
| 2,569,764 | 10/1951 | Jonas | 36/68 |
| 3,238,689 | 3/1966 | Cook, Jr. | 49/490.1 X |
| 3,515,623 | 6/1970 | Bates | 161/86 |
| 4,288,483 | 9/1981 | Miska et al. | 49/475.1 X |
| 4,343,845 | 8/1982 | Burden et al. | 49/490.1 X |
| 4,413,033 | 11/1983 | Weichman | 49/490.1 X |
| 4,748,078 | 5/1988 | Doi et al. | 66/202 X |
| 4,750,339 | 6/1988 | Simpson, Jr. et al. | 66/202 X |
| 5,204,157 | 4/1993 | Matsumiya | 49/490.1 X |

FOREIGN PATENT DOCUMENTS

| | | |
|---|---|---|
| 0175818 | 4/1986 | European Pat. Off. . |
| 0384613 | 8/1990 | European Pat. Off. . |
| 1407412 | 9/1975 | United Kingdom . |
| 8800989 | 2/1988 | WIPO . |

*Primary Examiner*—John J. Advert
*Attorney, Agent, or Firm*—Cumpston & Shaw

[57] ABSTRACT

A knitted wire carrier for use in the manufacture of weather seals comprising, a wire folded into a zig-zag configuration for carrying a plurality of polymeric warp threads knitted on the wire and at least one meltable filament laid-in into at least two adjacent warp threads, whereby on heating, the melted filament causes the at least two adjacent warp threads to be bonded to the wire and/or to each other. The resulting wire carrier is stabilized against warp drift and is useful in the manufacture of a wire carrier reinforced weather seal. A method of manufacturing the carrier using a modified knitter is provided.

23 Claims, 3 Drawing Sheets

KNITTED WIRE CARRIER HAVING BONDED WARP THREADS AND METHOD FOR FORMING SAME

FIELD OF THE INVENTION

This invention relates generally to a wire carrier for reinforcing a weather seal and more particularly to a carrier in which a meltable filament is laid-in into selected groups of adjacent warp threads to cause bonding of the warp threads to the wire support and/or to each other, and to a method for forming the same with a modified knitter.

BACKGROUND OF THE INVENTION

Knitted wire carriers are well known. Basically, such carriers comprise a continuous wire weft formed into a zig-zag formation with substantially parallel limbs interconnected by connecting regions at each end of the limbs onto which weft is knitted a plurality of warp threads. These warp threads can be of small wire, a synthetic resin or a natural fiber.

Such a wire carrier is widely used, mainly as a reinforcing frame for coated polymeric products, especially extrusion coated products, such as weather seals on motor vehicles. During manufacture of the seals, the carrier is passed through an extruder and is thus subjected to stresses and temperatures which can cause the warp threads to drift laterally, stretch longitudinally and degenerate both physically and chemically. This can result, for example, in breakage of the warps and distortion of the wire carrier which affects the extrusion process and leads to reduced quality and performance of the corresponding seal. In forming and extrusion processes drifting of the warp threads can cause air bubbles and exposure of the wire in the final weather seal. There has long been a need to develop a stable knitted wire carrier for extruded and molded polymeric products which overcomes these problems and many attempts have been made without complete success.

One attempt to solve the problem of lateral warp shifting formed adjacent zig-zag loops into a propeller or banana shape, but this is difficult to control, and has little effect on preventing lateral warp drifting.

In another attempt to solve the problem, Beck et al, EP Application No. 0175818, have suggested a knitted wire carrier with knotted junctions between the warp threads and the wire weft. Both the warp threads and the wire weft comprise polymeric or polymeric coated material and the polymeric material of the warp and the weft must both be melted to form a weld or fusion at the crossover points. This structure suffers from several disadvantages. It is difficult and expensive to provide either a polymer-coated wire weft, or the combination of an uncoated wire weft with a polymeric material which is fed to the knitting machine with the wire. Furthermore the use of polymeric meltable materials in both the warp and weft increases the cost of the wire carrier. These disadvantages increased the costs enough that it could not be used commercially.

EP 0384613 discloses a knitted wire carrier in which stitched warp threads comprise two threads of polymeric material having different melting points such that when the melting point of the lower melting thread is exceeded the melted thread causes the other thread to be attached to the wire weft. This structure allows single strands of warp thread plied with a meltable filament to be bonded to the wire carrier wherever they are knitted.

In an attempt to prevent movement and fraying at the edges of cut selvages of fabric woven with inorganic materials, such as glass fiber or metallic wire, U.S. Pat. No. 35 15623 discloses a woven carrier for reinforcing roofing and wrapping papers in which a thermoplastic strand is incorporated with one or more of the warp strands adjacent to the cut. On heating, the thermoplastic strand melts and collapses toward the crossover points to hold the strands in place. This deposition of the melted strand at the crossover points could produce an uneven, raised finish which is not desirable in a weather seal as it could result in air bubbles and exposed wire. Although the thermoplastic strand can cause a narrowing of the space between the warp strands there is no suggestion of contact between, or bonding together of adjacent warp strands.

None of the above described constructions provides an entirely satisfactory structure for a knitted wire carder having polymeric warp threads attached to a wire support for use in a weather seal. A knitted wire carrier which allows close grouping and bonding of adjacent warp threads in varying widths at selected positions on the wire affords a strong, stable wire carder and greater control of the subsequent product.

Accordingly, it is an object of this invention to provide a strong, stable wire carrier essentially free of warp drift by knitting warp threads on a wire support and laying-in a meltable filament into groups of adjacent warp threads.

It is another object of this invention to provide such a wire carrier which allows close grouping of adjacent warp threads at selected positions on the wire.

It is another object of this invention to provide such a wire carrier which allows bonding of different numbers of adjacent warp threads to the wire.

It is another object of this invention to provide such a wire carder which allows bonding of different numbers of adjacent warp threads to each other.

It is yet another object of this invention to provide a method for constructing such a wire carder using existing knitters without the need for substantial modification.

It is yet another object of this invention to provide a wire carder which allows greater control of the profile, appearance, quality and performance of a weather seal formed from the wire carrier.

SUMMARY OF THE INVENTION

Briefly stated and in accordance with a presently preferred embodiment of this invention, there is provided a knitted wire carrier for use in a weather seal comprising:

a wire folded into a zig-zag configuration so as to have a plurality of generally parallel limbs interconnected at alternate ends by connecting regions for carrying polymeric warp threads on the parallel limbs;

a plurality of polymeric warp threads knitted on the wire; and at least one meltable filament laid-in into at least two adjacent warp threads, whereby upon heating, the melted filament bonds the at least two adjacent warp threads to the wire.

According to another aspect of this invention the melted filament bonds the at least two adjacent warp threads to each other.

According to another aspect of this invention at least one shrinkable filament laid-in into at least two adjacent warp threads shrinks without melting to draw the warp threads together and draw the warp threads tightly against the wire.

According to another aspect of this invention the at least two adjacent warp threads comprises at least four adjacent warp threads.

According to another aspect of this invention the wire is uncoated.

According to another aspect of this invention the warp threads of the wire carrier comprise a synthetic resin or a natural fiber, preferably a synthetic resin selected from a polyester, a polypropylene and a nylon.

According to another aspect of this invention the meltable filament of the wire carrier comprises a thermoplastic polymer, preferably a polyolefin.

According to another aspect of this invention there is provided a method for manufacturing a wire carrier for use in a weather seal comprising the steps of:

forming a wire on a knitter into a zig-zag configuration having a plurality of generally parallel limbs interconnected at alternate ends by connecting regions for carrying polymeric warp threads on the parallel limbs;

feeding a plurality of polymeric warp threads to the knitter;

feeding at least one meltable filament to the knitter;

knitting the warp threads on the wire and simultaneously laying-in the at least one meltable filament into at least two adjacent warp threads; and heating said wire carrier to a temperature sufficient to cause shrinking of the at least one meltable filament to draw the warp threads together and draw the warp threads tightly against the wire.

According to another aspect of this invention there is provided a method for heating the wire carder to a temperature sufficient to cause melting of the at least one meltable filament, thereby causing the at least two adjacent warp threads to be bonded to the wire by the melted filament.

According to another aspect of this invention there is provided a method for heating the wire carder to a temperature sufficient to cause melting of the at least one meltable filament, thereby causing the at least two adjacent warp threads to be bonded to each other by the melted filament.

According to another aspect of this invention there is provided a method for heating the wire carder to a temperature sufficient to cause melting of the at least one meltable filament, thereby causing the at least two adjacent warp threads to be bonded to the wire and to each other by the melted filament.

According to another aspect of this invention, the heated wire carder is passed between forming rolls, thereby pressing the melted filament on to the wire and the warp threads to enhance bonding and maintain the flat profile of the wire carrier.

According to another aspect of this invention there is provided a weather seal for use on motor vehicles comprising a knitted wire carrier of this invention coated with an elastomer.

While the novel aspects of the invention are set forth with particularity in the appended claims, the invention itself, together with further objects and advantages thereof may be more readily understood by reference to the following derailed description of a presently preferred embodiment of the invention taken in conjunction with the following drawings in which;

DETAILED DESCRIPTION OF THE INVENTION

Figure 1:
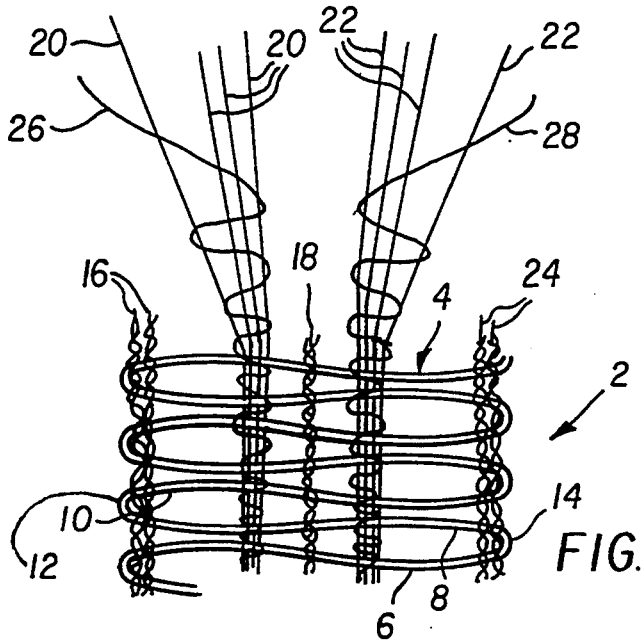
FIG. 1 is a perspective drawing of a wire carrier in accordance with a first embodiment of this invention.

A knitted wire carder in accordance with this invention is shown in the perspective drawing, FIG. 1. The carder 2 includes a length of wire support 4, preferably uncoated, formed into a weft having a zig-zag configuration of generally parallel limbs 6, 8, 10 interconnected at alternate ends by connecting regions 12, 14 which define the edges of the carrier. The zig-zag configuration of the wire can be extended to any desired length for carrying the warp threads. Preferably the wire 4 is an uncoated length of about 30 mil (0.76 mm) diameter steel wire, for example carbon steel or 301 stainless steel wire. The wire may be coated with a non-meltable protective layer, for example, with a rust protective coating.

A plurality of polymeric warp threads 16, 18, 20, 22, 24, for example, is knitted on the wire support to reinforce the wire support and form a knitted wire carrier. The warp threads encompass the wire within a stitch of each knitted row of warp yarn. The warp threads are knitted on the wire, preferably with chain stitching to minimize warp drift and the warp threads are pretensioned, for example, to 0.5–2 pounds per warp end, preferably 1 pound. However, to prevent warp drift selected groups of adjacent warp threads 20, 22 are knitted on the wire and simultaneously at least one meltable filament 26, 28 respectively, is laid-in into the grouped adjacent warp threads. The meltable filament is kept under minimal tension.

The warp threads comprise a polymeric material. By polymeric we mean a polymer based on organic or organo-silicone chemistry. The polymer may be a synthetic resin or a natural fiber such as cotton. Synthetic resins are more durable and resistant to the stresses incurred during fabrication of the coated product, for example during extrusion, and are preferred. Suitable polymeric materials include, for example polyesters, polypropylenes and nylons. The polyester, polyethylene terephthalate, is particularly suitable.

The meltable filament is a thermoplastic polymer. Particularly useful thermoplastics are monofilament or multifilament yarns of polyolefins, for example polypropylene or polyethylene, nylon or polyesters. Thermoplastic materials such as these and others which inherently shrink on heating close to their melting points are particularly useful. The meltable filament has a melting point of less than about 275° C., preferably less than about 225° C., more preferably between about 175° and 215° C. A single filament ribbon yarn of about ⅛th inch (3.2 mm) width polypropylene is particularly useful.

The warp threads and the meltable filament preferably have a size of about 1000 denier, however, they need not be the same size.

FIG. 1 illustrates the selection of two groups of four adjacent warp threads which are knitted on the wire, preferably with chain stitching, and having a single meltable filament laid-in into each group. For clarity the chain stitching is not shown. The groups of adjacent warp threads are positioned at either side of a center warp thread 18 and are intermediate between the center and the outside warp threads 16 and 24. It is to be understood that the selected groups of adjacent warp threads can contain two or more threads and that one or more groups of adjacent threads can be selected for simultaneous laying-in with one or more meltable filaments. The positioning of the selected groups on the wire support can be varied depending on the application for the finished coated product. Also, the number and positioning of the warp threads which are not laid-in with a meltable filament can be varied to give any desired pattern with the grouped threads incorporating the meltable filament.

In FIG. 1 the grouped adjacent warp threads are shown as separated lines for clarity. The closeness of knitted warp threads is limited by the spacing of the needles on the needle bar which is normally not less than about 1/16th inch (1.6 mm). In the wire carrier of this invention selected groups of adjacent warp threads are knitted as close together as practical while simultaneously laying-in the meltable filament under tension. In practice, the tension on the meltable filament draws the selected group of adjacent warp threads towards each other so that contact can occur. On heating up the wire carrier, the adjacent threads are drawn even closer together by shrinkage of the filament and firmly contact each other. Subsequently on melting, the melted filament is bonded to the wire and/or to the warp threads and, on solidification, separation of the warp threads is prevented. In a preferred embodiment of this invention the warp threads are bonded to the wire by the melted filament and are locked in place. In an even more preferred embodiment of this invention the warp threads are bonded to the wire and to each other by the melted filament, thus forming a strong, tightly bound, yet still flexible network of the warp threads and the filament, which network is locked in place. Such knitted wire carriers are especially suitable for use in weather seals.

In an alternative embodiment of the invention the groups of adjacent warp threads are bonded together by the melted filament without being bonded to the wire. This embodiment provides a strong, tightly bound network of the warp threads and the melted filament in which longitudinal stretching is prevented and latitudinal drift is restricted. Thus the warp threads are held on the wire more firmly than for a corresponding knitted wire carrier without the laid-in meltable filament and warp drift is minimized.

In yet another embodiment of the invention the group of adjacent warp threads is drawn together and drawn tightly against the wire by shrinkage of a laid-in shrinkable filament without melting. This embodiment provides a strong, tightly bound network of the warp threads and the meltable filament in which longitudinal stretching and latitudinal drifting of the warp threads are restricted. Thus the warp threads are held on the wire more firmly than for a corresponding knitted wire carrier without the laid-in meltable filament and warp drift is minimized.

In a warp knitting process a laid-in thread is a thread which is connected into a basic ground structure, but which is not formed into knitted loops. It is held into a knitted ground structure by trapping it between the face loop and the underlap of the knitted warp threads.

Figure 2:
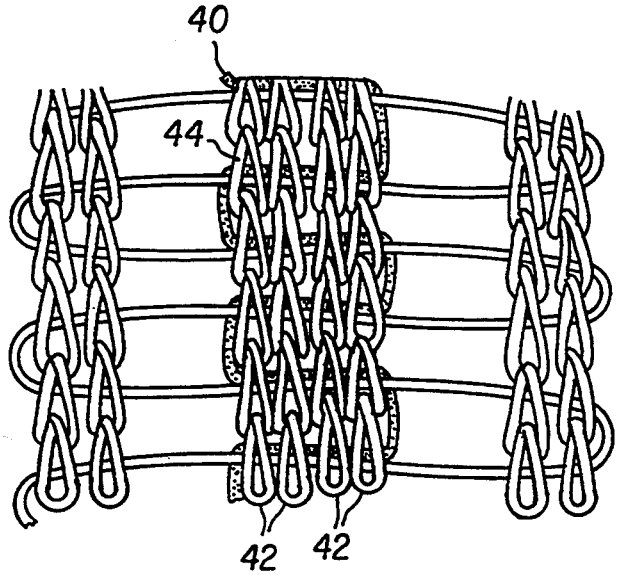
FIG. 2 is a detail of the wire carrier of FIG. 1 illustrating the laying-in of the meltable filament.

FIG. 2 illustrates in greater detail how the meltable filament 40 is laid-in into a group of four chain stitched warp threads 42. The meltable filament 40 is trapped between the face loop 44 and the underlap (not shown) of the warp threads as the stitches are knitted. The meltable filament extends around each edge of the grouped threads and the grouped threads are held in close proximity to each other by the tension on the meltable filament. The adjacent threads are not necessarily in contact with each other at this stage.

Figure 3:
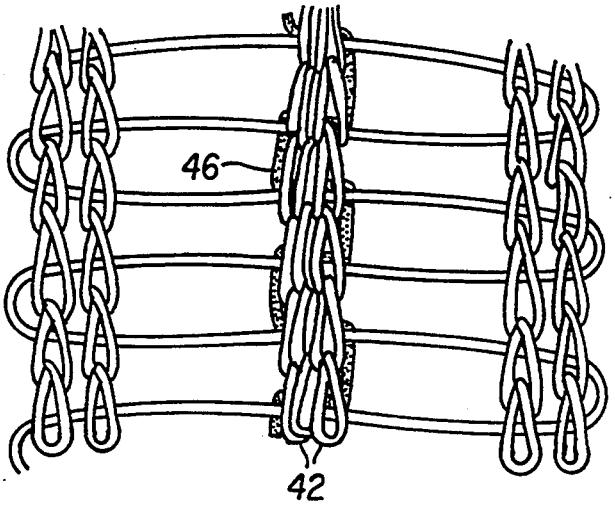
FIG. 3 is a detail corresponding to FIG. 2 showing how the laid-in melted filament draws in the adjacent warp threads.

FIG. 3 illustrates how the warp threads 44 of FIG. 2 are drawn in by shrinkage of the meltable filament 46 so that the adjacent threads are firmly in contact with each other.

Figure 4:
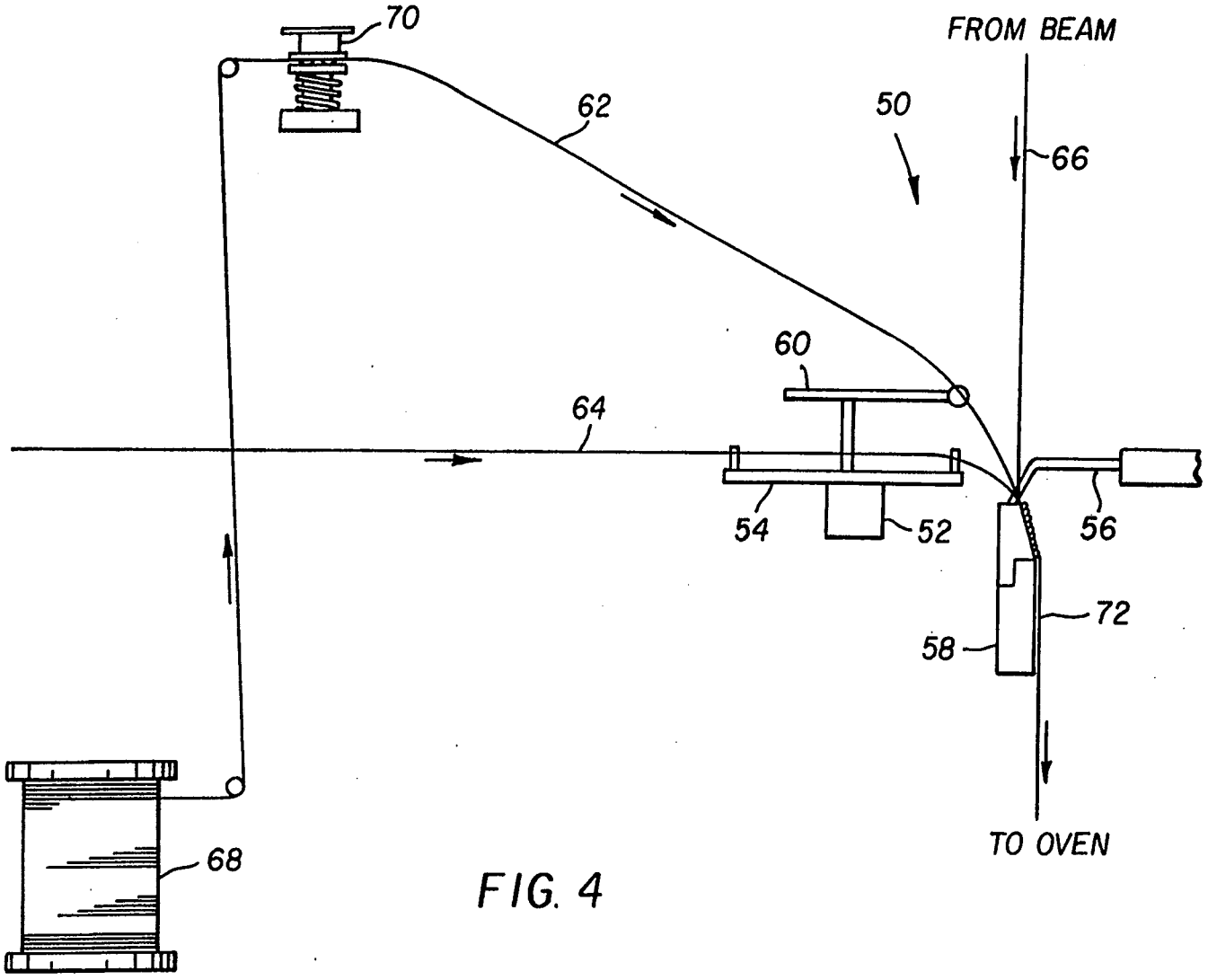
FIG. 4 is a side view illustration of the manner in which the wire carder of the present invention is formed.

Knitting of the wire carder is carried out on a conventional knitter modified to include a filament feed system, as illustrated schematically in FIG. 4. The knitter 50 consists essentially of a wire-throw bar 52 carrying a wire guide 54, a knitter finger 56 for folding the wire into a zig-zag configuration, and a needle bar 58 on which the wire is knitted with the warp threads to form a knitted wire carder. The knitter is modified to carry a guide 60 on the wire-throw bar for the meltable filament 62 so that the meltable filament is simultaneously laid-in into a selected group of the warp threads. Additional guides for the meltable filament are added for each selected group of adjacent warp threads and positioned as needed by the desired pattern.

The wire 64 is fed from a supply drum through the wire guide 54 to form the wire weft of the carrier into a zig-zag configuration on which the warp threads are knitted, for example, with chain stitching. A plurality of warp threads 66 is fed to the knitter 50 from a beam or a plurality of supply cones, under a tension of from about 0.5–2 pounds per warp end, preferably about 1 pound. The meltable filament is fed from a supply 68 to a tensioner device 70 and then through the guide 60 to the needle bar 58. The tensioner device 70 applies pressure to the meltable filament to tighten the filament and as the guide 60 brings the strand of filament back and forth through the knitting warp threads, tension on the filament is maintained. The meltable filament guide and the wire guide move back and forth as the warp threads are chain stitched around them. The meltable filament is thus simultaneously laid-in into the selected group of the adjacent warp threads. The knitted wire carrier 72 is then pulled from the knitter to a heat source, for example an oven.

Figure 5:
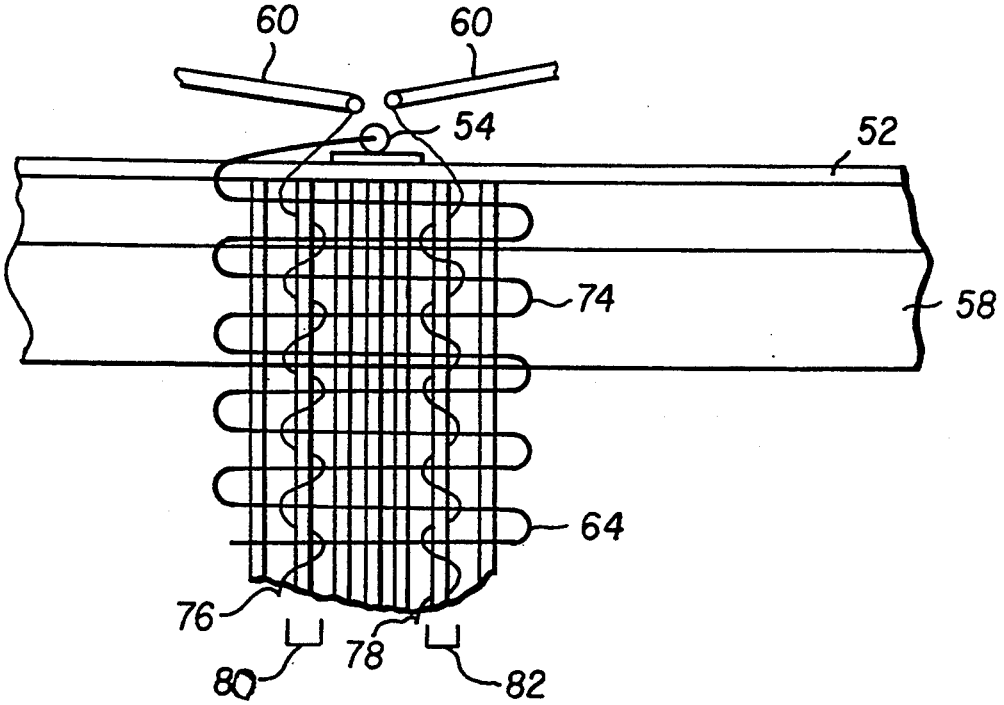
FIG. 5 is a front view illustration of one aspect of the manner in which the wire carder of the present invention is formed.

FIG. 5 illustrates, in part, a front view of the knitter and shows how the wire weft 74 is formed into a zig-zag configuration by the wire guide 54 and how the guides 60 feed the meltable filaments 76, 78 parallel to the wire 64 and into the groups of adjacent warp threads 80, 82 respectively. The relative positions of the needle bar 58 and the wire-throw bar 52 are readily apparent.

In the method of this invention at least one meltable filament is simultaneously fed into the knitting process and laid-in into the selected group of knitted, adjacent warp threads. Preferably a single meltable filament is laid-in and trapped between the face loop and the underlap of at least two adjacent warp threads. The meltable filament parallels the travel of the wire by means of the guide attached to the wire-throw bar. The guide angle is adjusted in relation to the knitting plane to cross through as many adjacent warp threads as are desired to be grouped and bonded to a certain position on the wire. Thus, through the standard knitting process, the selected warp threads knit on the wire and entrap the meltable filament. After the wire carrier has been knitted but before it is handled in any operation that tends to displace the warp threads the warp threads are bonded into position on the wire support by heating the knitted wire carrier.

On heating the knitted wire carder up close to the melting point of the filament shrinkage of the filament can occur and cause the threads to be drawn even closer together. Heating the meltable filament causes the filament to shrink as the temperature approaches the melting point of the filament due to the memory properties of the filament. This phenomenon is common to many polymeric materials, especially those which have been subjected to elongation processes during their manufacture, for example, filament formation. Thus a group of adjacent warp threads is closely held together through the tensioning and shrinkage of the meltable filament.

Bonding of the grouped warp threads is accomplished by heating the wire carrier as it travels between the knitter and the finished product take-up apparatus. Heating above the melting point of the meltable filament causes the meltable filament to flow onto the wire support and/or into the grouped adjacent warp threads. The flowing of the melt allows a flat profile to be maintained along the warp threads and at the crossover points with the wire. On cooling, the melted filament hardens and the grouped adjacent warp threads are bonded in position. In a preferred embodiment of the invention, the grouped adjacent warp threads are bonded to the wire support and to each other so that on cooling, the grouped warp threads are locked in a given position. Such a wire carder has a flat profile, is longitudinally stable and is virtually free of warp drift.

Heating of the knitted wire carder can be accomplished by a variety of methods which allow the carrier to be heated close to or above the melting point of the meltable filament. In a preferred embodiment of the invention heating above the melting point of the meltable filament is carried out for a period of time sufficient to cause the melted filament to flow onto the wire and into the warp threads. One such method comprises heating the wire carrier by exposing it to a flow of heated air in an oven in the range of 240° to 270° C., for 3–5 minutes preferably about 4 minutes. Another method comprises heating the wire carrier with infrared radiation at between 25–30 watts/in 2 for about 7 minutes. Another method comprises passing the wire carrier over a heated roller. Another method requires induction heating of the wire. Depending on the melting point of the meltable filament used, variations in the time and temperature conditions needed to melt and bond the filament can be determined by persons skilled in the field. In another embodiment of the invention the hot wire carrier is passed between forming rolls to press the melted filament firmly onto the wire and into the warp threads. This roll treatment can also help to maintain the flat profile of the wire carder. The roll forming treatment can be applied during the heating process or immediately after the hot wire carrier exits the heater. Cooling of the knitted wire carrier is accomplished by exposure to ambient temperatures for a period of time after pulling the carrier from the heater. The period of time necessary to harden the melted filament is readily determined by those skilled in the field.

Knitted wire carriers of this invention are particularly useful as reinforcements for elastomeric weather seals on motor vehicles, for example, as trunk seals or as edge protector strips for doors and windows of vehicles. The elastomeric materials, for example, a thermoplastic or thermosetting elastomer are coated on the wire carrier by conventional extrusion or molding processes. The knitted wire carrier of this invention is particularly useful for extrusion processes due to its flat profile, the virtual absence of warp drift and longitudinal stability under the conditions of the extrusion process. Weather seals frequently require forming a wire carrier into a generally U-shaped configuration and it is during this process that damage to the reinforcement is likely to occur. The wire carrier of this invention allows positioning of the groups of bonded warp threads at the parts of the seal requiring the most reinforcement, for example, the base or the sides of the U-shaped seal.

The invention provides a strong, physically and chemically stable wire carrier, essentially free of warp drift, with a desirable flat profile, allows close grouping and selective positioning of adjacent warp threads, and allows grouping and bonding of different numbers of adjacent warp threads. Warp damage is minimized in the subsequent extrusion coating processes and, overall, greater control of the profile, appearance and quality of the product is achieved. The process uses existing knitting equipment with a minimum of modification and is effective in reducing manufacturing costs.

While the invention has been described in connection with a presently preferred embodiment thereof, those skilled in the art will recognize that many modifications and changes may be made therein without departing from the true spirit and scope of the invention, which accordingly is intended to be defined solely by the appended claims.

What is claimed is:

1. A knitted wire carrier for use in a weather seal comprising:

a wire folded into a zig-zag configuration so as to have a plurality of generally parallel limbs interconnected at alternate ends by connecting regions for carrying polymeric warp threads on the parallel limbs;

a plurality of polymeric warp threads knitted on the wire to encompass the wire within a stitch of each knitted row of warp yarn; and at least one shrinkable filament laid-in into at least two adjacent warp threads, wherein when heated, the filament is shrunk and the at least two adjacent warp threads are drawn tightly against the wire.

2. A knitted wire carrier for use in a weather seal comprising:

a wire folded into a zig-zag configuration so as to have a plurality of generally parallel limbs interconnected at alternate ends by connecting regions for carrying polymeric warp threads on the parallel limbs;

a plurality of polymeric warp threads knitted on the wire to encompass the wire within a stitch of each knitted row of warp yarn;

at least one shrinkable filament laid-in into at least two adjacent warp threads, wherein when heater, the filament is shrunk and the at least two adjacent warp threads are drawn tightly against each other.

3. The knitted wire carrier of claim 1, in which the filament shrinks and draws the at least two adjacent warp threads tightly each other.

4. The knitted wire carrier of claim 1, in which the at least one shrinkable filament consists of monofilament or multi filament yarn.

5. The knitted wire carrier of claim 1, in which the wire is uncoated.

6. The knitted wire carrier of claim 1, in which the warp threads comprise a synthetic resin or a natural fiber.

7. The knitted wire carrier of claim 6, in which the synthetic resin comprises a polyester, a polypropylene or a nylon.

8. The knitted wire carrier of claim 1, in which the filament comprises a thermoplastic polymer.

9. The knitted wire carrier of claim 8, in which the thermoplastic polymer comprises a polyolefin.

10. The knitted wire carrier of claim 8 in which the thermoplastic polymer comprises a heat shrinkable polymer.

11. A knitted wire carrier for use in a weather seal comprising:

a wire folded into a zig-zag configuration so as to have a plurality of generally parallel limbs interconnected at alternate ends by connecting regions for carrying polymeric warp threads on the parallel limbs;

a plurality of polymeric warp threads knitted on the wire to encompass the wire within a stitch of each knitted row of warp yarn;

at least one shrinkable filament laid-in into at least two adjacent warp threads, wherein when heated, the filament shrinks without melting to draw the warp threads together and draw the warp threads tightly against the wire.

12. A weather seal for use on motor vehicles comprising:

a knitted wire carrier according to any one of the preceding claims;

and a polymeric coating comprising a thermoplastic or thermosetting elastomer coated on said knitted wire carrier.

13. The weather seal of claim 12, in which the polymeric coating comprises an extruded thermoplastic elastomer.

14. A method for manufacturing a wire carrier for use in a weather seal comprising the steps of:

forming a wire on a knitter into a zig-zag configuration having a plurality of generally parallel limbs interconnected at alternate ends by connecting regions for carrying polymeric warp threads on the parallel limbs;

feeding a plurality of polymeric warp threads to the knitter;

feeding at least one :meltable filament to the knitter;

knitting the warp threads on the wires to encompassing the wire within a stitch of each knitted row of warp yarn and simultaneously laying-in the at least one shrinkable filament into at least two adjacent warp threads;

heating said wire carrier to a predetermined temperature to drawing the warp threads together by shrinking the at least one shrinkable filament; and drawing the warp threads tightly against the wire.

15. The method of claim 14, in which the wire carrier is further heated to a temperature predetermined to cause melting of the at least one shrinkable filament, thereby causing the at least two adjacent warp threads to be bonded to the wire by the melted filament.

16. The method of claim 15, in which the heating of said wire carrier further causes the at least two adjacent warp threads to be bonded to each other by the melted filament.

17. The method of claim 14, in which the wire carrier is further heated to a predetermined temperature to cause melting of the at least one shrinkable filament, thereby causing the at least two adjacent warp threads to be bonded to each other by the melted filament.

18. The method of claim 14, in which said heating step comprises heating said carrier with infrared radiation.

19. The method of claim 14, in which said heating step comprises heating said carder in an oven.

20. The method of claim 14, in which said heating step comprises passing said carder over a heated roller.

21. The method of claim 16, in which said heating step comprises heating said carrier with infrared radiation at between 25–30 watts/in$^2$ for about 7 minutes.

22. The method of claim 16, in which said heating step comprises exposing said carrier to a flow of heated air in an oven in the range of 240° to 270° C. for about 3–5 minutes.

23. The knitted wire carrier of claim 4, in which the at least one filament consists of one monofilament yarn or one multifilament yarn.

* * * * *